US010596838B2

(12) United States Patent
Tsukuda et al.

(10) Patent No.: US 10,596,838 B2
(45) Date of Patent: Mar. 24, 2020

(54) PRINTING APPARATUS

(71) Applicant: CANON KABUSHIKI KAISHA, Tokyo (JP)

(72) Inventors: Masakazu Tsukuda, Yokohama (JP); Atsushi Kohnotoh, Kawasaki (JP); Tsuyoshi Yoshida, Kawasaki (JP); Yuki Emoto, Tokyo (JP); Koki Shimada, Kawasaki (JP); Kuniaki Sato, Inagi (JP); Yasufumi Tanaami, Tokyo (JP); Kanto Kurasawa, Tokyo (JP); Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/686,027

(22) Filed: Aug. 24, 2017

(65) Prior Publication Data

US 2017/0348986 A1 Dec. 7, 2017

Related U.S. Application Data

(62) Division of application No. 15/083,112, filed on Mar. 28, 2016, now abandoned.

(30) Foreign Application Priority Data

Apr. 2, 2015 (JP) ..... 2015-076283
Aug. 4, 2015 (JP) ..... 2015-154352

(51) Int. Cl.
*B41J 11/06* (2006.01)
*B41J 2/17* (2006.01)
(Continued)

(52) U.S. Cl.
CPC ..... *B41J 11/0065* (2013.01); *B41J 2/17* (2013.01); *B41J 2/1721* (2013.01); *B41J 11/06* (2013.01); *B41J 2002/1742* (2013.01)

(58) Field of Classification Search
CPC ..... B41J 2/1721
See application file for complete search history.

(56) References Cited

U.S. PATENT DOCUMENTS 8,955,961 B2 * 2/2015 Ota ..... B41J 11/0065 347/101
2004/0008231 A1 * 1/2004 Park ..... B41J 25/308 347/8

(Continued)

FOREIGN PATENT DOCUMENTS

CN 1727195 A 2/2006
CN 101254714 A 9/2008

(Continued)

*Primary Examiner* — Shelby L Fidler
(74) *Attorney, Agent, or Firm* — Canon U.S.A., Inc. IP Division

(57) ABSTRACT

In a printing apparatus, a platen configured to support a sheet to be printed includes an ink receiver configured to receive ink discharged from a print head. The ink receiver includes a plurality of first ink grooves and a plurality of second ink grooves configured to guide the received ink, the second ink grooves having a tilt angle greater than that of the first ink grooves. The platen includes an absorber configured to absorb the ink received by the ink receiver, the absorber being arranged on a back side of the ink receiver.

9 Claims, 9 Drawing Sheets

(51) Int. Cl.
*B41J 2/185* (2006.01)
*B41J 11/00* (2006.01)

(56) References Cited

U.S. PATENT DOCUMENTS

2004/0150703 A1* 8/2004 Nojima ..... B41J 11/20 347/104
2006/0170749 A1* 8/2006 Watanabe ..... B41J 11/0065 347/104
2006/0256180 A1* 11/2006 Asano ..... B41J 11/20 347/104
2008/0106570 A1* 5/2008 Kanai ..... B41J 2/1721 347/22
2008/0111843 A1* 5/2008 Kodama ..... B41J 2/185 347/9
2008/0180508 A1* 7/2008 Ota ..... B41J 11/057 347/104
2009/0184992 A1 7/2009 Igarashi
2013/0050372 A1* 2/2013 Lo ..... B41J 3/60 347/104
2014/0028746 A1* 1/2014 Chen ..... B41J 11/20 347/8
2014/0232789 A1* 8/2014 Mimoto ..... B41J 2/1433 347/47
2014/0232800 A1* 8/2014 Sano ..... B65H 29/125 347/104

FOREIGN PATENT DOCUMENTS

CN 202412940 U 9/2012
JP 10166562 A * 6/1998 ..... B41J 2/01
JP 2004231389 A 8/2004
JP 2008094086 A 4/2008
JP 2014069397 A 4/2014
JP 2014156072 A 8/2014

* cited by examiner

PRINTING APPARATUS

The present application is a division of U.S. patent application Ser. No. 15/083,112, filed Mar. 28, 2016, entitled "PRINTING APPARATUS", the content of which is expressly incorporated by reference herein in its entirety. Further, the present application claims priority from Japanese Patent Application No. 2015-076283, filed Apr. 2, 2015, and Japanese Patent Application No. 2015-154352, filed Aug. 4, 2015, each of which is also hereby incorporated by reference herein in its entirety.

BACKGROUND OF THE INVENTION

Field of the Invention

The present invention relates to an inkjet printing apparatus.

Description of the Related Art

Japanese Patent Application Laid-Open No. 2006-35685 discusses an inkjet printing apparatus which can perform borderless printing. A platen for supporting a sheet has a plurality of ink guide grooves formed by a large number of ribs which are arranged along a conveyance direction of the sheet. An ink absorber is arranged downstream of the ink guide grooves. Excess ink that is discharged toward and impinges on the platen during borderless printing is guided by the ink guide grooves which are slightly tilted, and is absorbed by the ink absorber provided on the platen.

In the printing apparatus discussed in the foregoing Japanese Patent Application Laid-Open No. 2006-35685, the ink absorber provided on the platen is arranged in a narrow space below the ribs on the downstream side. Since the ink absorber has a small capacity, if the printing apparatus is used for a long period of time, the ink absorber becomes unable to absorb ink any more. Then, ink accumulates on the platen. If such ink accumulates in large amounts, the ink overflows from the platen and drips into the interior of the printing apparatus, whereby the interior of the printing apparatus is contaminated.

If the printing apparatus discussed in the foregoing Japanese Patent Application Laid-Open No. 2006-35685 is installed on a non-horizontal, tilted installation surface, a problem similar to the one described above can occur depending on the angle and direction of the tilt. More specifically, if the tilt of the installation surface cancels out the tilt of the platen and the platen is on a horizontal line, the ink which has impinged on the platen does not flow but accumulates in the ink guide grooves. If the tilt of the installation surface is greater, the ink in the ink guide grooves flows not toward the absorber (to a downstream side) but backward (to an upstream side) by gravity. If such ink flows backward in large amounts, the ink drips off from the platen to contaminate the interior of the printing apparatus.

If a sheet passes over the ink accumulated on the platen as described above, the ink adheres to the back of the sheet to cause a stain on the sheet. Further, if the accumulated ink drips into the interior of the printing apparatus, since the printing apparatus is structurally difficult to clean, the liquid component of the ink can cause problems such as erosion of component parts and a short circuit in electrical parts.

SUMMARY OF THE INVENTION

The present invention is directed to providing an improved inkjet printing apparatus that causes less ink stains than heretofore.

According to an aspect of the present invention, a printing apparatus includes an inkjet print head, and a platen configured to support a sheet to be printed. The platen includes an ink receiver configured to receive ink discharged from the print head in which a plurality of grooves configured to guide the received ink is formed, wherein the plurality of grooves includes a plurality of ink grooves having a first tilt angle with respect to an installation surface of the printing apparatus, and a plurality of second ink grooves having a tilt angle greater than the first tilt angle.

Further features of the present invention will become apparent from the following description of exemplary embodiments with reference to the attached drawings.

DESCRIPTION OF THE EMBODIMENTS

Figure 1:
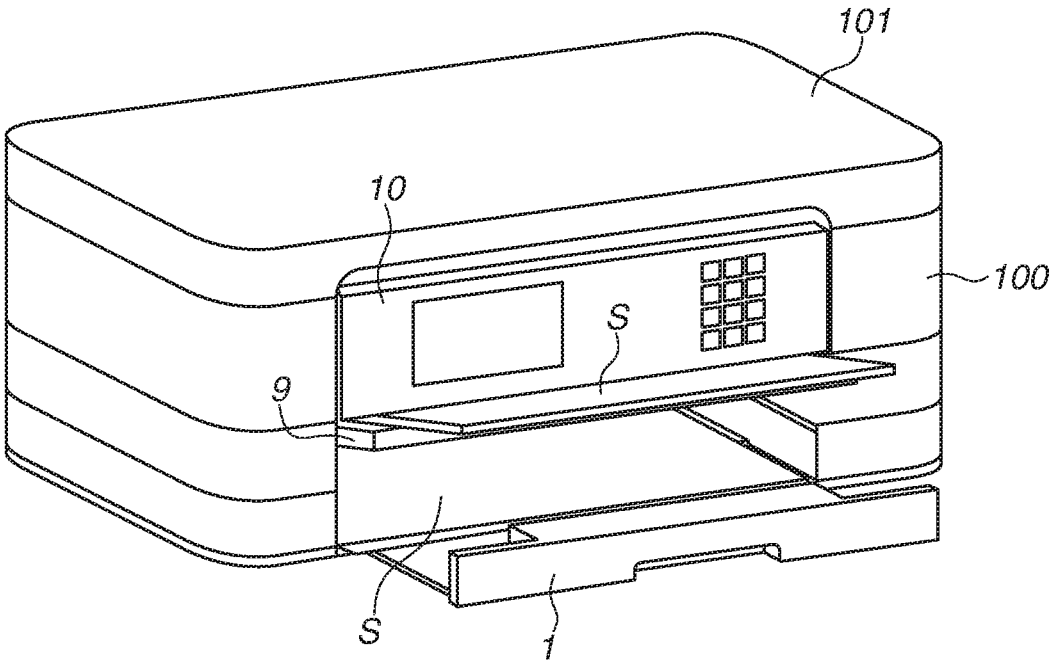
FIG. 1 is a perspective view illustrating an appearance of a printing apparatus according to an exemplary embodiment.
Figure 2:
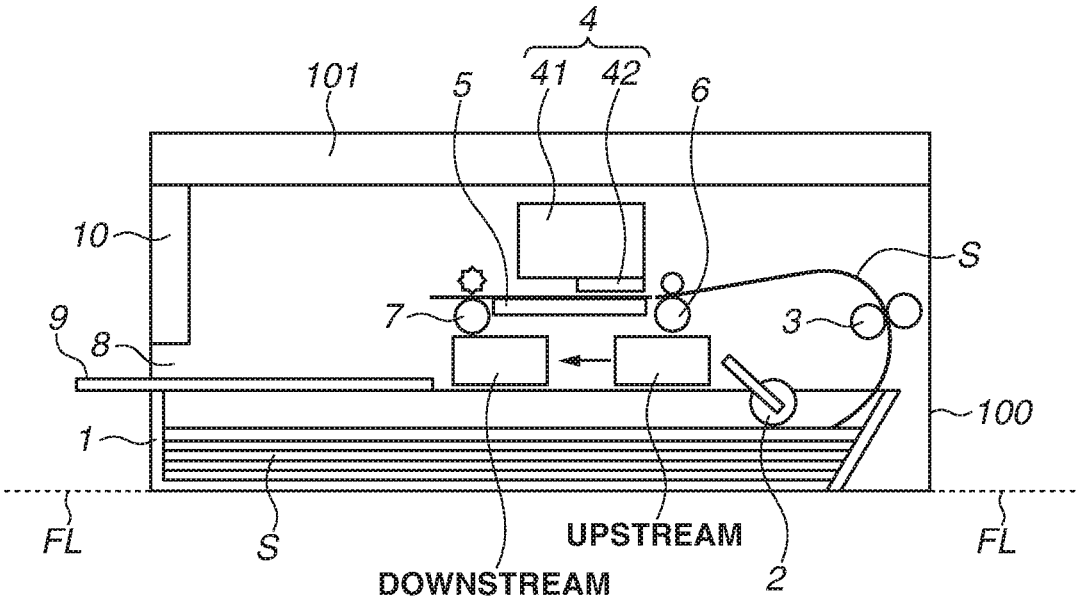
FIG. 2 is a sectional view illustrating an internal configuration of the printing apparatus.

FIG. 1 is a perspective view illustrating an appearance of a printing apparatus according to an exemplary embodiment of the present invention. FIG. 2 is a sectional view illustrating an internal configuration of the printing apparatus. The printing apparatus is roughly divided into a print unit 100 and a scanner unit 101 thereon. An operation panel 10 including a display unit and input keys is arranged on a front surface of the printing apparatus. As illustrated in FIG. 2, the printing apparatus, when in use, is placed on an installation surface FL such as a floor and a desktop. The installation surface FL is usually a horizontal surface perpendicular to the direction of gravity.

The print unit 100 includes a cassette 1, a pickup roller 2, and a printing section 4 (including a carriage 41 and a print head 42). The print unit 100 further includes a sheet conveyance unit which includes a feed roller 3, a main conveyance roller 6, and a discharge roller 7, and a tray 9 which supports a printed sheet or sheets discharged from a discharge port 8. A platen 5 for supporting a print target sheet from below is arranged opposite to the printing section 4. An exemplary embodiment of the present invention has a structure of the platen 5 as a characteristic feature, which will be described below.

The printing apparatus is not limited to a multifunction peripheral having both a printing function and a scanner function as in the present exemplary embodiment. The printing apparatus may be an apparatus that further includes other functions as a combination such as a facsimile. The printing apparatus may also be a single-function apparatus. The printing system is not limited to a serial printer, and may be a line printer in which longitudinal line heads are fixedly arranged in a row.

Sheets S, or recording media, stacked and stored in the cassette 1 are taken out by the pickup roller 2 one by one, and conveyed over the platen 5 by the sheet conveyance unit. After an image is printed on a sheet S by the printing section 4, the sheet S is discharged onto the tray 9 from the discharge port 8. The print head 42 is an inkjet print head using a heat generation element or a piezoelectric element. The print head 42 includes a nozzle array corresponding to a plurality of colors of ink, and prints a color image.

The sheet S is conveyed over the platen 5 from the right to the left of the plane of FIG. 2. The carriage 41 reciprocates in a sheet width direction of the sheet S (direction perpendicular to the plane of FIG. 2) while printing and step feeding of the sheet S are repeated for each band to perform printing in a serial manner. As employed herein, an upstream side of the platen 5 in the conveyance direction of the sheet S may be referred to simply as "upstream," and a downstream side in the conveyance direction of the sheet S as "downstream."

The printing apparatus can perform borderless printing without margins on edges of a sheet S. If an image is borderlessly printed on a leading edge of a sheet S being conveyed, some of ink droplets discharged from the nozzle array of the print head 42 are applied to the leading edge of the sheet S. Ink droplets from the rest of the nozzles run off an edge (the downstream side) of the sheet S and impinge on a surface of the platen 5. To receive the ink, an ink receiver 50 described below is provided on the surface of the platen 5. As the printing proceeds, an image is borderlessly printed on a trailing edge of a last sheet S. Here, some of the ink droplets discharged from the nozzle array of the print head 42 are applied to the trailing edge of the sheet S. Ink droplets of the rest of the nozzles run off an edge (the upstream side) of the sheet S, and are received by the ink receiver 50. If an image is borderlessly printed not only on the leading and trailing edges of the sheet S but also on sheet edges in the sheet width direction of the sheet S (in the direction perpendicular to the plane of FIG. 2), the ink running off the edge of the sheet S is similarly received by the ink receiver 50.

Other than borderless printing, the ink receiver 50 is also used in a preliminary discharge operation for preventing clogging of the print head 42 and an increase of ink viscosity. The preliminary discharge operation is performed before or during execution of a print operation by discharging a small number of ink droplets from each of the nozzles of the print hear 42 toward the ink receiver 50.

Figure 3:
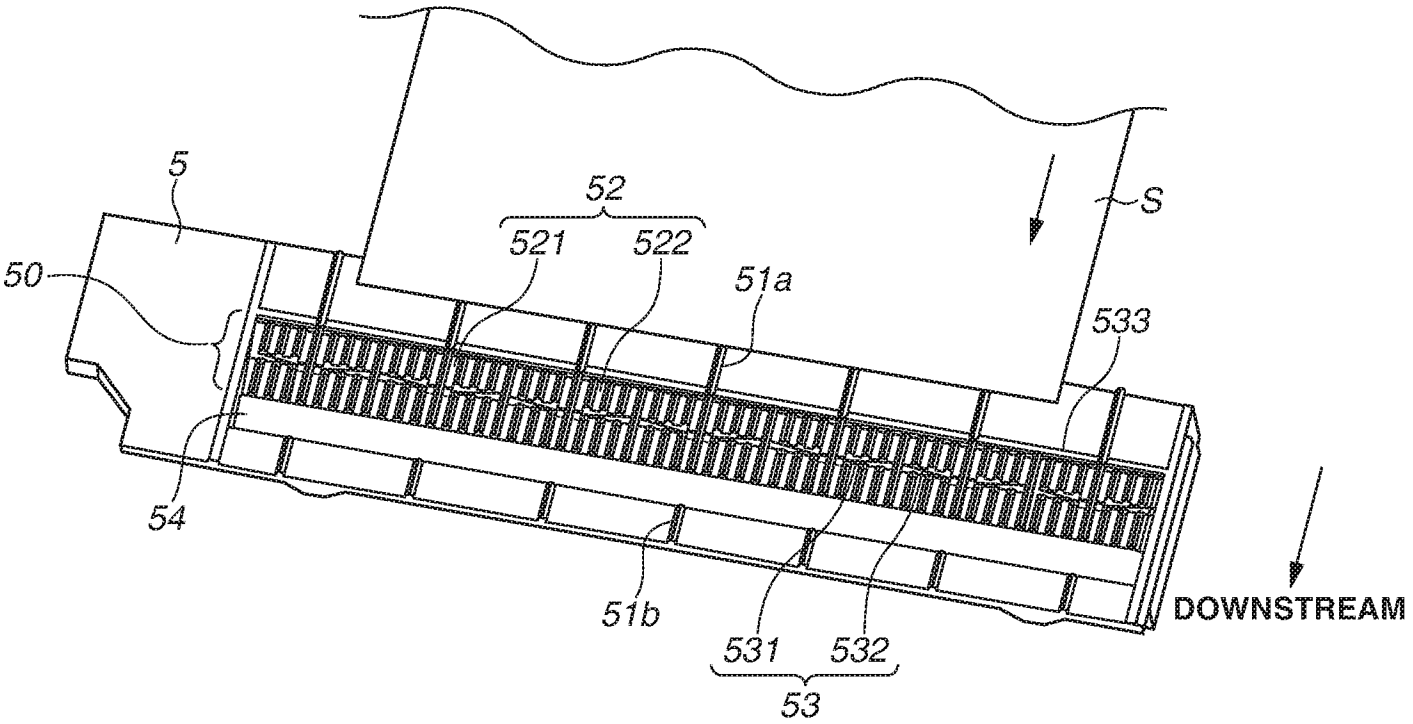
FIG. 3 is a perspective view illustrating a structure of a platen according to a first exemplary embodiment.
Figure 4:
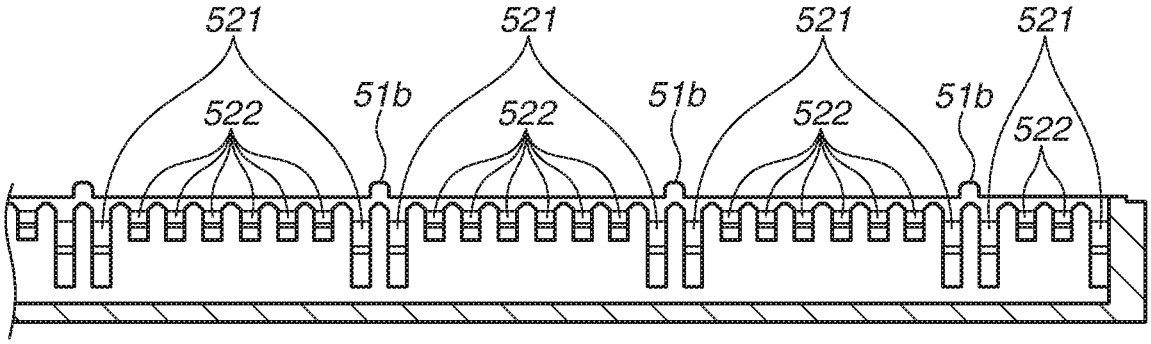
FIG. 4 is a sectional view illustrating a detailed structure of an ink receiver (sectional view at a most downstream part).

The platen 5 according to the first exemplary embodiment will be described in detail below. FIG. 3 is a perspective view illustrating a structure of the platen 5 according to the first exemplary embodiment as seen obliquely from above. FIG. 4 is a sectional view illustrating a detailed structure of the ink receiver 50. FIG. 4 is a sectional view of a most downstream part of the ink receiver 50 as seen from the downstream side in the sheet conveyance direction (from an ink absorber to be described below).

A plurality of ribs 51*a* (upstream) and ribs 51*b* (downstream) for supporting a conveyed sheet S from below is provided on the surface of the platen 5. The ink receiver 50 for receiving ink droplets discharged from the print head 42 is formed between the ribs 51*a* and 51*b* in the sheet conveyance direction.

The ink receiver 50 includes an ink absorber 54 and an ink guide portion 52 (longitudinal groove group) for guiding excess ink which has impinged on the ink receiver 50 downstream toward the ink absorber 54. The ink absorber 54 is made of a fibrous or porous material that absorbs excess ink. The ink absorber 54 has the shape of a rectangular parallelepiped that is long in the sheet width direction, and covers a range wider than a maximum sheet width to be used. The ink absorber 54 is held in contact with the ink receiver 50 and embedded in a recess of the platen 5 on the downstream side of the ink receiver 50.

Figure 8A:
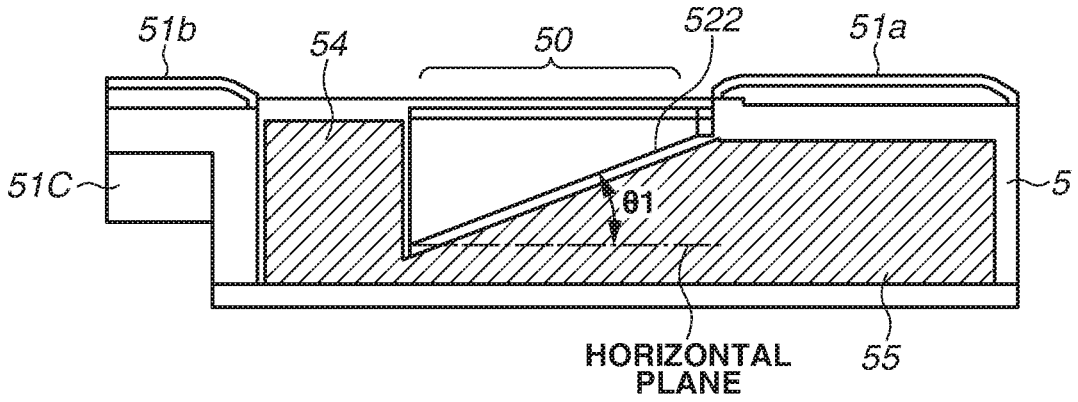
FIGS. 8A and 8B are sectional views for describing a structure of an ink absorber embedded in the platen and a change in a tilted state of the platen.

As illustrated in FIG. 8A, an ink absorber 55 is further embedded in an internal space of the platen 5, or more specifically, under (also referred to as on a back side or rear side of) the ink guide portion 52 and the ribs 51*a* formed on the surface of the platen 5. The ink absorber 55 is made of a material similar to that of the ink absorber 54 which is made of a thick porous sheet. Like the ink absorber 54, the ink absorber 55 covers a long range in the sheet width direction. In the present example, the ink absorbers 54 and 55 are one integrated sheet. However, the ink absorbers 54 and 55 may be configured as separate members which are put in close contact and connected with each other.

The ink absorber 54 is arranged between the ink receiver 50 and the downstream ribs 51*b* in the sheet conveyance direction. If the platen 5 is seen from above, the surface of the ink absorber 54 is exposed on the front side of the platen 5. The ink absorber 55 is arranged to spread out under (on the back side of) the upstream ribs 51*a* and under (on the back side of) the ink receiver 50. If seen from above, the ink absorber 55 is hidden under and not exposed from such members.

The internal space of the platen 5 is thus utilized to provide the platen 5 with a large-capacity ink absorber. The ink that is discharged from the print head 42 and received by the ink receiver 50 is first absorbed by the ink absorber 54 and moves gradually to the ink absorber 55. The combination of the ink absorbers 54 and 55 can absorb a large amount of ink. Even if the printing apparatus is run for a long period of time, a large amount of link can be contained without leakage. This prevents the occurrence of an ink accumulation on the platen 5 which may cause an ink stain.

In this example, the ink absorber 55 is arranged over a wide range that covers the areas from under the ink receiver 50 to under the upstream ribs 51*a*. However, the ink absorber 55 is not limited to such a structure. The ink absorber 55 can increase its capacity more than heretofore and can achieve the foregoing effect if the ink absorber 55 is arranged at least under the ink receiver 50.

Figure 9:
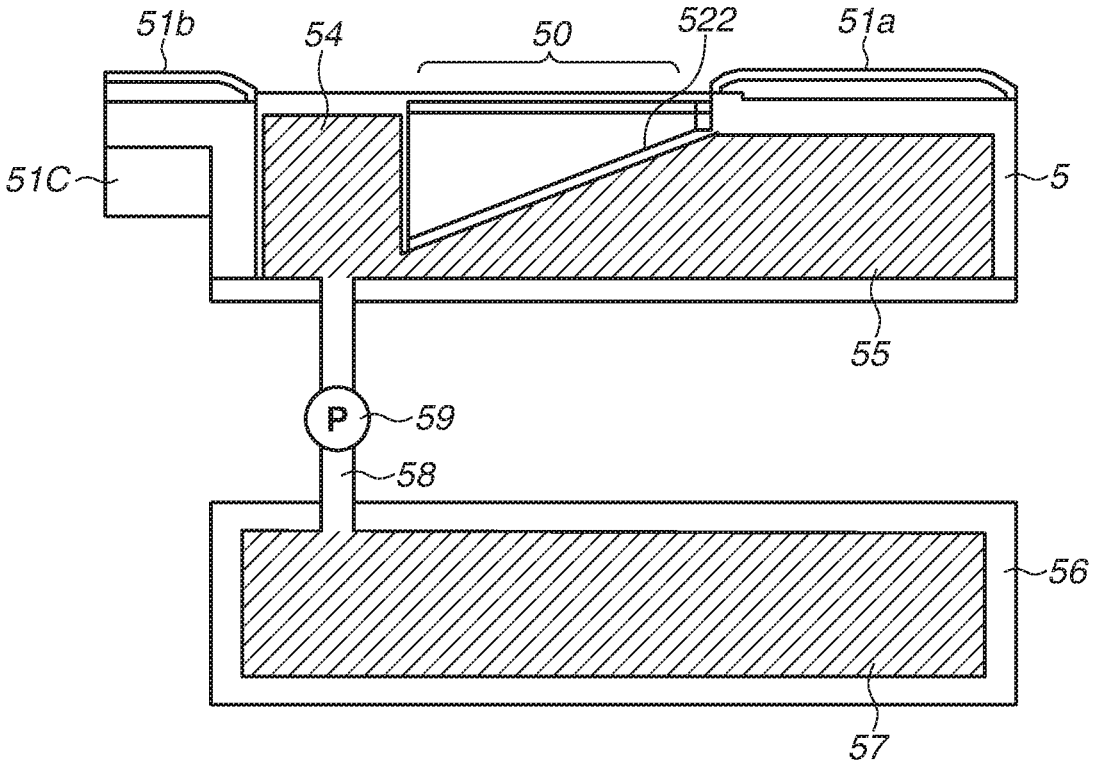
FIG. 9 is a diagram illustrating a configuration example where a large-capacity ink absorber unit is added.

To further increase the capacity of the ink absorbers, as illustrated in FIG. 9, a large-capacity ink absorber unit 56 may be added in a remote position below the platen 5. The ink absorber unit 56 includes a large-capacity ink absorber 57 inside, and is connected to a lower part of the platen 5 via a tube 58. Waste ink that is once received by the ink absorber 54 on the platen 5 and stored in the lower part inside the platen 5 is transferred to the ink absorber unit 56 through the tube 58. A pump 59 is provided to increase the transfer efficiency, although it is not necessarily required. Thus, with the configuration in which the separate tank absorber unit 56 is added under the platen 5, the ink absorber 55 may be omitted.

The ink guide portion 52 includes a large number of small tilt grooves 522 (first ink grooves) and a small number of large tilt grooves 521 (second ink grooves) for guiding ink by gravity and a capillary phenomenon toward the downstream side where the ink absorber 54 is provided. In other words, a large number of rigs having the same height are arranged at equal distances, and tilt grooves having a tilted groove bottom are formed between adjoining ribs. The tops of the many ribs have a uniform height, which is lower than the tops of the ribs 51 and 51*b*, with which the platen 5 supports a sheet S. Accordingly, the back side of the conveyed sheet S is prevented from making contact with the tops of the many ribs of the ink receiver 50. This prevents the back side of the sheet S from getting a stain.

The large tilt grooves 521 have a larger tilt angle in the sheet conveyance direction and are smaller in number than the small tilt grooves 522. In this example, two adjoining large tilt grooves 521 are arranged for every six small tilt grooves 522 in the sheet width direction. On the surface of the platen 5, one upstream rib 51*a*, one rib between adjoining large tilt grooves 521, and one downstream rib 51*b* are arranged in a straight line. In such a manner, the number of tilt grooves constituting the ink guide portion 52 is greater than the number of ribs 51*a* and 51*b* for supporting the sheet S.

The large tilt grooves 521 and the small tilt grooves 522 are both formed to tilt with respect to a horizontal plane. Excess ink impinged on the ink receiver 50 is thus smoothly guided by the action of gravity toward the downstream side where the ink absorber 54 is located. The large tilt grooves 521 have a tilt angle of 10° with respect to a horizontal plane. The small tilt grooves 522 have a tilt angle of 3° with respect to a horizontal plane. The plurality of small tilt grooves 522 may include grooves having a plurality of different tilt angles which are smaller than 10°. The large tilt grooves 521 and the small tilt grooves 522 may be shaped such that the tilt angle of each groove changes in between.

The ink receiver 50 further includes an ink guide portion 53 (lateral groove group) for guiding ink in a direction (sheet width direction) substantially orthogonal to the ink guide portion 52. The ink guide portion 53 includes lateral grooves 531 and 532 (third ink grooves) which have a tilt angle with respect to a horizontal plane and are alternately arranged in a straight line on the whole. The lateral grooves 531 and 532 are arranged to cross near a center of the plurality small tilt grooves 522 (center in the sheet conveyance direction) along the sheet width direction. A rib 533 for preventing ink which has flowed upstream, from overflowing onto the surface of the platen 5 is continuously formed most upstream of the ink receiver 50 along the sheet width direction. The ribs 51*a* are provided on the surface of the platen 5 further upstream of the rib 533. The ribs 51*b* are provided on the surface of the platen 5 further downstream of the ink absorber 54.

Figure 5:
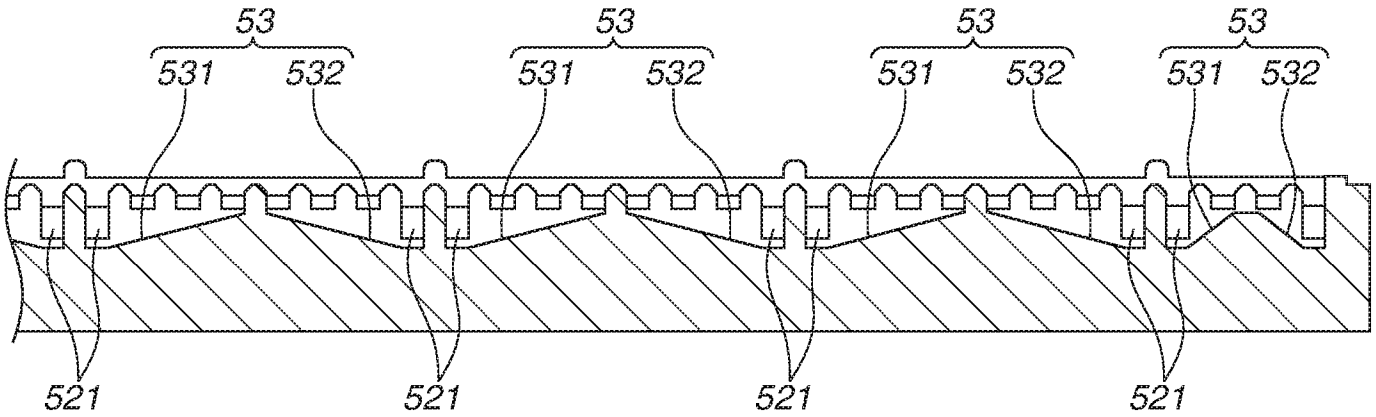
FIG. 5 is a sectional view illustrating a detailed structure of the ink receiver (sectional view along lateral grooves).

FIG. 5 is a sectional view illustrating a structure of the ink guide portion 53. FIG. 5 is a sectional view of the platen 5 near the center in the sheet conveyance direction. A lateral groove 531 or 532 is provided for each large tilt groove 521. The lateral grooves 531 and 532 tilt in different directions. The lateral grooves 531 and 532 are both formed to tilt downward to become lower toward the corresponding large tilt grooves 521 so that ink flows toward the large tilt grooves 521 by the action of gravity.

To facilitate the ink flow utilizing a capillary phenomenon, the large and small tilt grooves 521 and 522 is desirably formed so that the guide grooves have a V-shaped cross section. The large and small tilt grooves 521 and 522 may be formed to have a non-uniform groove width so that a cross-sectional area of the guide grooves decreases as it gets closer to the ink absorber 54. Similarly, the lateral grooves 531 and 532 can be formed to have a V-shaped cross section. The lateral grooves 531 and 532 may be formed so that the cross-sectional area of the guide grooves decreases as it gets closer to the large tilt grooves 521. To further facilitate the ink flow, a water repellent fluorine coating or gloss finishing can be applied to the surfaces of the small tilt grooves 522, the large tilt grooves 521, and the lateral grooves 531 and 532.

Figure 6:
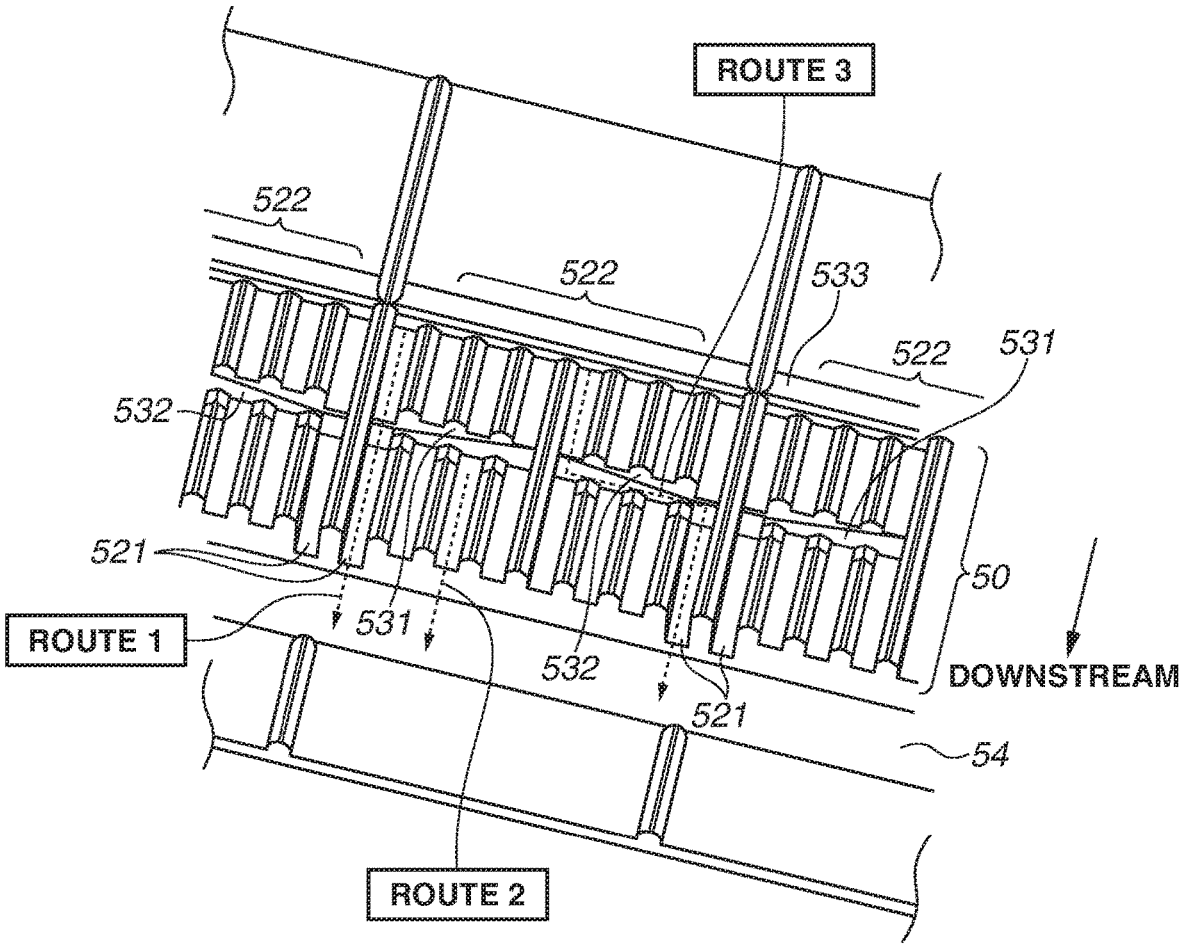
FIG. 6 is a diagram illustrating a plurality of ink channels on the ink receiver which leads to an ink absorber.

FIG. 6 is a diagram illustrating a plurality of ink channels on the ink receiver 50 leading to the ink absorber 54. Ink which has impinged on the ink receiver 50 is guided to the ink absorber 54 through three routes. A first route (dotted line indicating route 1) is a channel through which ink flows from a large tilt groove 521 to the ink absorber 54. A second route (dotted line indicating route 2) is a channel through which ink moves from a small tilt groove 522 to a large tilt groove 521 via a lateral groove 531 or 532 (in FIG. 6, lateral groove 532) and flows from the large tilt groove 521 to the ink absorber 54. A third route (dotted line indicating route 3) is a channel through which ink flows from a small tilt groove 522 lying downstream of the ink guide portion 53 to the ink absorber 54.

For ease of understanding, FIG. 6 illustrates only one representative channel for each of the three types of routes by a dotted line. Other similar channels are omitted. For example, a plurality (in this example, three) of small tilt grooves 522 is assigned to each of the plurality of large tilt grooves 521. Therefore, ink from any of the assigned small tilt grooves 522 flows similarly to the ink absorber 54 by route 2.

Most of ink droplets discharged from the print head 42 to the outside of a sheet S during borderless printing or a preliminary discharge impinge on the small tilt grooves 522 which have a higher area ratio in the ink receiver 50. Most of the ink is thus guided to the ink absorber 54 by routes 2 and 3. Some of the ink droplets from the print head 42 impinge on the large tilt grooves 521, and are guided through the large tilt grooves 521 to the ink absorber 54 as it is. The installation surface FL on which the printing apparatus is installed is usually horizontal, and the ink flows as intended.

If the printing apparatus is installed with some tilt, the flow of the ink in the small tilt grooves 522 may stagnate. Even in such a case, the ink moves to the large tilt grooves 521 through the lateral grooves 531 and 532, and is reliably guided to the ink absorber 54 by the large tilt grooves 521. The ink is thereby prevented from accumulating in the ink receiver 50 and causing a stain on the sheet S.

As described above, the large tilt grooves 521 have a tilt angle of 10° with respect to a horizontal plane, and the small tilt grooves 522 have a tilt angle of 3° with respect to a horizontal plane. If the installation surface FL has a tilt of 3° or more with the downstream side of the printing apparatus heightened, the small tilt grooves 522 are positioned tilting with their upstream side lowered. As a result, the ink which has impinged on the small tilt grooves 522 flows back upstream. The ink which has impinged on the small tilt grooves 522 downstream of the lateral grooves 531 and 532 flows a little upstream and moves to the large tilt grooves 521 via the lateral grooves 531 and 532. Since in the large tilt grooves 521, their downstream side lies low unless the installation surface FL is tilted by 10° or more, the ink flows downstream and is absorbed by the ink absorber 54. Meanwhile, the ink which has impinged on the small tilt grooves 522 on the upstream side of the lateral grooves 531 and 532 flows upstream and is dammed by the rib 533 serving as a dam wall. The ink is thereby prevented from overflowing onto the surface of the platen 5 which is arranged further upstream. In actuality, the user is unlikely to put the printing apparatus on an installation surface FL that is tilted 10° or more. The setting of 10° can thus preclude a possibility of occurrence of the problem. The foregoing angle settings are just an example. The tilt angles are not limited thereto. Any tilt angles are usable as long as a condition that the large tilt grooves 521 have a tilt angle larger than the small tilt grooves 522 is satisfied.

In this case, the backflow of the ink can be prevented by making not only the tilt angle of the large tilt grooves 521 but also that of the small tilt grooves 522 large (for example, 10°). This, however, causes another problem of increased ink mist. More specifically, the distance from the nozzles of the print head 42 to the bottoms of the ink grooves increases in all the areas. This increases the flying distance of the discharged ink droplets before impingement, so that the amount of generation of ink mist is increased. The generated ink mist floats inside the printing apparatus, and adheres to and stains the components of the printing apparatus and sheets S. The occurrence of ink mist therefore needs to be suppressed as much as possible. In the present exemplary embodiment, the ink grooves are functionally separated between the small tilt grooves 522 and the large tilt grooves 521. A large proportion of the ink grooves are configured as small tilt grooves 522 to reduce the number of large tilt grooves 521 where ink mist is likely to occur. As a result, most of the ink droplets are received by the small tilt grooves 522, so that the smaller ink flying distance reduces the occurrence of ink mist.

A second exemplary embodiment related to the platen 5 will be described below. In the second exemplary embodiment, a mechanism for changing the tilt angle of the ink receiver 50 is provided to forcibly drain ink from the ink receiver 50 at predetermined timing, whereby an operation effect similar to those of the foregoing first exemplary embodiment are obtained.

Figure 7:
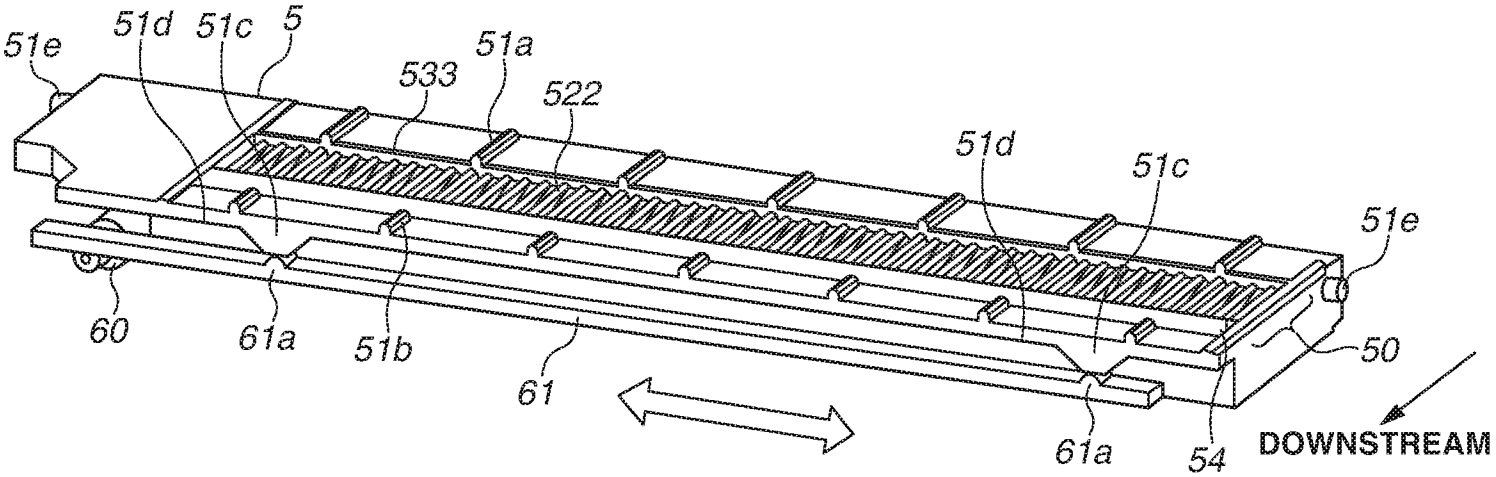
FIG. 7 is a perspective view illustrating a structure of a platen according to a second exemplary embodiment.
Figure 8B:
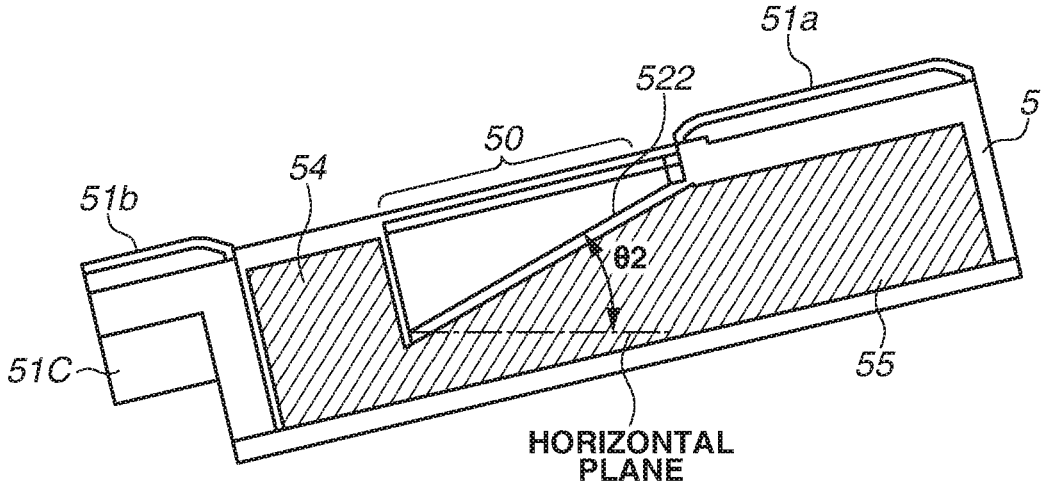

FIG. 7 is a perspective view illustrating a structure of a driving mechanism for changing the tilt angle of the platen 5. FIGS. 8A and 8B are sectional views for illustrating a change in a tilted state of the platen 5. The entire printing apparatus is similar to that described in FIGS. 1 and 2 above. A description thereof will thus be omitted.

Unlike the foregoing first exemplary embodiment, the ink receiver 50 of the platen 5 includes only small tilt grooves 522. The ink absorber 54 is embedded in the platen 5 on the downstream side of the ink receiver 50. Like the first exemplary embodiment, the rib 533 is provided most upstream of the ink receiver 50, the ribs 51*a* are provided on the surface of the platen 5 further upstream, and the ribs 51*b* are provided on the surface of the platen 5 downstream of the ink absorber 54. Like the first exemplary embodiment, the ink absorber 55 is arranged in the internal space of the platen 5 under the ribs 51*a* and the ink receiver 50. As illustrated in FIG. 9, an additional large-capacity ink absorber may be connected via a tube.

Shafts 51*e* are arranged in an upstream position on both lateral sides of the platen 5. The platen 5 is rotatably supported so that the platen 5 can rotate about the shafts 51*e* to move the downstream side of the platen 5 up and down. To drive the platen 5, a driving mechanism including a motor 60 and a slide plate 61 is arranged under the platen 5. The slide plate 61 is moved to slide sideways by rotation of the motor 60. Two ribs 61*a* having a semi-cylindrical shape are formed on the slide plate 61. V-shaped cam portions 51*c* are formed on a back surface 51*d* of the downstream side of the platen 5, at two positions opposite to the ribs 61*a*.

If the slide plate 61 is positioned such that the two ribs 61*a* make contact with the two cam portions 51*c*, the downstream side of the platen 5 is lifted up and the platen 5 is put in a horizontal position illustrated in FIG. 8A. The ink receiver 50 formed in the platen 5 is almost parallel to the print head 42. Like the foregoing exemplary embodiment, the small tilt grooves 522 of the ink receiver 50 are at a tilt angle of θ1 (here, 3°) with respect to a horizontal plane. If the motor 60 is rotated to slide the slide plate 61 sideways, the two ribs 61*a* are separated from the cam portions 51*c*. The platen 5 rotates accordingly and the downstream side comes down. As a result, the platen 5 takes a tilted position illustrated in FIG. 8B. In such a state, the small tilt grooves 522 of the ink receiver 50 are at a greater tilt angle of θ2 (here, 10°) with respect to a horizontal plane. That is, there holds the relationship $\theta 1<\theta 2$. For ease of understanding, the tilt angles θ1 and θ2 are exaggerated in FIGS. 8A and 8B.

In a normal state or at least when ink is discharged to a sheet S, the platen 5 is put in the horizontal position of FIG. 8A. The distance between the print head 42 and the ink receiver 50 of the platen 5 is thereby minimized to decrease the occurrence of ink mist. In a print operation, ink droplets discharged toward the ink receiver 50 for borderless printing or a preliminary discharge are received by the ink receiver 50. During the print operation, the small tilt grooves 522 of the ink receiver 50 are at the tilt angle θ1 (here, 3°) with respect to a horizontal plane and the ink flows downstream.

However, if, as described above, the installation surface FL of the printing apparatus is tilted, the flow of the ink in the small tilt grooves 522 may stagnate, or the ink may in some cases flow back upstream and fail to be drained. To forcibly drain the accumulated ink, the platen 5 is then temporarily put into the tilted position of FIG. 8B at predetermined timing. In the tilted position, the small tilt grooves 522 are at the tilt angle θ2 which is greater than θ1. Even if the installation surface FL is not horizontal, the ink is reliably guided to the ink absorber 54 downstream. The ink is thus forcibly drained from the ink receiver 50.

Such an ink draining operation is intended to drain the ink accumulated in the ink receiver 50, and is thus performed at predetermined timing after an operation for discharging ink, such as a print operation and a preliminary discharge operation is finished. For example, the ink draining operation may be performed once after printing of an image or images of a job or a plurality of jobs is finished, and once after a preliminary discharge operation on the ink receiver 50 is performed. The platen 5 may be maintained at the tilted position during a period other than print operations and preliminary discharge operations. The printing apparatus may include a tilt sensor, and may be controlled to perform the ink draining operation only if a tilt of the printing apparatus is detected. Such timing is also an example of the predetermined timing at which the ink draining operation is performed.

The direction in which to tilt the platen 5 is not limited to that of the second exemplary embodiment. The platen 5 may be tilted in the orthogonal sheet width direction by using a driving mechanism. In the second exemplary embodiment, the orientation of the entire platen 5 is changed by the driving mechanism. However, an outer frame of the platen 5 may be fixed, and the driving mechanism may change the orientation of only the inner portion of the ink receiver 50.

In the second exemplary embodiment, the ink receiver 50 includes only the small tilt grooves 522. However, like the foregoing first exemplary embodiment, the ink receiver 50 may be configured to include a plurality of ink grooves having different tilt angles. In other words, the first and second exemplary embodiments may be combined. While in the first exemplary embodiment, ink may not be drained off if the installation surface FL has a tilt greater than 10°, the mechanism of the second exemplary embodiment can be combined to drain off such ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus comprising:

a conveyance roller configured to convey a sheet in a first direction;

a print head configured to perform a printing operation to discharge ink on a sheet conveyed by the conveyance roller;

a platen arranged opposite to the print head and configured to support a sheet;

a receiving portion arranged on the platen and configured to receive ink discharged from the print head;

an absorber arranged on the platen and configured to absorb ink;

a plurality of first ink grooves arranged on the receiving portion so as to extend in the first direction and configured to guide the ink from receiving portion to the absorber, wherein the tilt angle of the first ink groove with respect to an installation surface of the printing apparatus is a first angle; and a second ink groove arranged on the receiving portion and between the first ink grooves that are adjacent thereto so as to extend in the first direction and configured to guide the ink from the receiving portion to the absorber, wherein the tilt angle of the second ink groove with respect to the installation surface is a second angle that is larger than the first angle;

a slide member configured to change an orientation of the platen, wherein the orientation of the platen is a first orientation in which the tilt angle of the plurality of first ink grooves with respect to the installation surface is the first angle when the slide member moves to a first position, and the orientation of the platen is a second orientation in which the tilt angle of the first ink groove is a third angle that is larger than the first angle when the slide member moves to a second position, wherein the slide member moves to the first position when the printing operation is performed, and the slide member moves from the first position to the second position after completion of the printing operation.

2. The printing apparatus according to claim 1, further comprising a carriage configured to hold the print head and reciprocate, wherein borderless printing without margins on edges of a sheet is performable while the carriage is reciprocating on a sheet supported by the platen, and the receiving portion receives ink discharged from the print head to an outside of the sheet supported by the platen in the borderless printing.

3. The printing apparatus according to claim 2, wherein a downstream side of the platen in the first direction is lowered so that the platen comes into the second orientation when the slide member is moved from the first position to the second position, and the downstream side of the platen is lifted so that the platen comes into the first orientation when the slide member is moved from the second position to the first position.

4. The printing apparatus according to claim 3, wherein the slide member and portions on a back side of the platen are in contact with each other at two positions apart from each other in a second direction crossing the first direction, and a contact state of the slide member and the portions is changed at each of the two positions when the slide member is moved from the first position to the second position.

5. The printing apparatus according to claim 1, wherein a plurality of ribs configured to support a sheet from a back side of the sheet is arranged on the platen on each of an upstream side and a downstream side of the receiving portion in the first direction.

6. The printing apparatus according to claim 5, wherein a part of the absorber is exposed at a position different from the plurality of ink grooves formed on the receiving portion, as the platen is viewed from above.

7. The printing apparatus according to claim 6, wherein the ink groove has a tilted groove bottom and a groove width that tapers toward a downstream in a direction in which ink is moved along the groove bottom.

8. The printing apparatus according to claim 1, wherein the absorber is arranged on a back side of the platen, and wherein, as the platen is seen from the above, a first part of an upper surface of the absorber is exposed on a surface of the platen at a position different from the receiving portion in the first direction, and a second part of the upper surface of the absorber different from the first part is hidden under the surface of the platen.

9. The printing apparatus according to claim 1, wherein the plurality of ink grooves includes a first ink groove having a tilt angle with respect to the installation surface of the printing apparatus is the first angle when slide member moves to a first position and a second ink groove having a title angle larger than the first angle.

* * * * *